United States Patent [19]

Yoxon et al.

[11] Patent Number: 4,680,206

[45] Date of Patent: Jul. 14, 1987

[54] SEALED DOUBLE GLAZING UNIT

[75] Inventors: Brian Yoxon, Hoole; William Thilwind, Windle, both of England

[73] Assignee: Pilkington Brothers P.L.C., St. Helens, England

[21] Appl. No.: 828,271

[22] Filed: Feb. 11, 1986

[30] Foreign Application Priority Data

Feb. 19, 1985 [GB] United Kingdom ..... 8504275

[51] Int. Cl.[4] ..... E06B 3/24

[52] U.S. Cl. ..... 528/34; 52/788; 156/109

[58] Field of Search ..... 428/34; 156/109; 52/803, 825, 826, 304, 788

[56] References Cited

U.S. PATENT DOCUMENTS

| | | | |
|---|---|---|---|
| 2,300,506 | 11/1942 | Kamerer | 156/109 X |
| 2,302,740 | 11/1942 | Boicey | 52/304 |
| 2,552,955 | 5/1951 | Gaiser et al. | 428/34 X |
| 2,834,998 | 5/1958 | Wilder | 52/403 X |
| 4,242,386 | 12/1980 | Weinlich | 428/34 |
| 4,500,572 | 2/1985 | Francis | 428/34 |
| 4,581,868 | 4/1986 | McCann | 52/398 |

*Primary Examiner*—Henry F. Epstein

*Attorney, Agent, or Firm*—Burns, Doane, Swecker & Mathis

[57] ABSTRACT

A sealed double glazing unit has outer and inner panes (2, 3) and a perimeter seal (4, 5). The unit is fixed to a supporting structure at fixing positions within the perimeter seal. At each fixing position there is a fixing assembly (8, 12, 16) which is sealed into the unit and is attached to one pane only so that flexing of the unit under wind load is permitted. Preferably each fixing assembly is fixed to a hole (13) in one pane and passes through a hole (20) in the other pane with sufficient clearance to facilitate the flexing of the unit when it is installed as part of a glass wall assembly.

18 Claims, 6 Drawing Figures

SEALED DOUBLE GLAZING UNIT

This invention relates to sealed double glazing units of the kind comprising an outer pane and an inner pane which are spaced apart by a perimeter seal.

It is known to construct glass wall assemblies in which adjacent glass sheets are secured together and are secured to structural members of a building by means of metal plates to which the sheets are bolted.

It is desirable to construct glass wall assemblies from double glazing units, but when seeking to preserve the outward appearance of such units, in which the outer glass sheets appear to the observer to be mounted edge-to-edge, problems arise when attempting to mount the units without a frame enclosing the edges of each double glazing unit. Such units can be mounted either using adhesives or mechanical fixings for fixing the units to structural supporting members of a building. Mechanical fixing is preferred for greater mechanical security, but there are difficulties in securing a double glazing unit mechanically without enclosing the edges, while ensuring that the seal of the double glazing unit is maintained to prevent ingress of moisture into the air space between the panes of the unit.

In U.S. Pat. No. 4,581,868 there is described a construction in which sealed double glazing units are secured to supporting members, with the outer sheets of the units sealed edge-to-edge by a sealing compound, and each of the units secured to the supporting members by mechanical fixings which pass through flanges of the outer sheets outside the seals of the units.

It is an object of the present invention to provide another solution to the problem of mechanical fixing of a sealed double glazing unit to supporting members, which solution employs mechanical fixing means passing through the sealed air space of the double glazing unit, with a moisture-tight seal provided between the panes and the mechanical fixing, while permitting the double glazing unit to flex under variable loads, which are encountered in service, such as wind load.

SUMMARY

According to the invention there is provided a sealed double glazing unit comprising an outer pane and an inner pane which are spaced apart by a perimeter seal, and having at least one fixing position within the perimeter seal for fixing the unit without obstructing its outer edge, at which fixing position there is a fixing assembly which is attached to one of the panes in a manner which permits the unit to flex under wind load without impairing the seal of the unit.

Usually the unit is rectangular with a fixing position in the region of each corner. Preferably each fixing assembly passes through a hole in one of the panes and is clamped to that panel only. The fixing assembly may pass through a sealed hole in the other pane with a clearance sufficient to facilitate the flexing of the unit under wind load.

The fixing assembly may pass through a hole in the outer pane, and through a hole in the inner pane with a clearance sufficient to permit the unit to flex, and includes a boss positioned between and sealed to both panes.

Further according to the invention the fixing assembly may include a fixing member which passes through the hole in said one of the panes, and a boss through which the fixing member passes, which boss is positioned between and sealed to both panes and passes through the hole in the other pane with said clearance sufficient to facilitate flexing of the unit under wind load.

The fixing member may be a bolt whose head engages in a bush which is a free fit in a countersunk hole in the outer pane. Preferably the bush is made of a resilient material and has a tapered head which fits into the countersunk hole in the outer pane.

In one embodment the boss has an internal thread and is tightened on to an external thread on the bush to clamp the fixing assembly to the outer pane, and the fixing bolt projects from the bush for fixing to a supporting member.

Preferably the boss is a metal boss and carries a sealing ring between the boss and the outer pane, and has a reduced-diameter portion which is situated with clearance in a hole in the inner pane, which hole is filled with a sealing compound.

A sealing ring may be provided between the boss and the edge of the hole in the inner pane.

In another embodiment the fixing member is a fixing bolt whose head engages in a bush which is a free fit in a hole in the outer pane, the bush is clamped in the outer pane by a disc which is tightened on the fixing bolt, the fixing bolt passes with clearance through a hole in the inner pane, and an annular spacer which is sealed to both panes surrounds the fixing bolt and the hole in the inner pane.

In yet another embodiment the boss is located with clearance in a hole in the outer pane and is sealed within that hole and is sealed to the inner pane and has a central, externally-threaded extension which passes through the hole in the inner pane, a threaded disc is screwed on to that extension to clamp the boss to the inner pane, and the fixing member is a fixing bolt which passes through the boss and its extension for fixing to a supporting member.

In a simple embodiment for use in certain applications the fixing assembly includes a fixing member which passes through a hole in the inner pane and is clamped to the inner pane and sealed in that hole prior to assembly of the unit.

Where the outer pane of the unit is of glass, it is preferably of toughened glass to withstand the loads placed on it in service. The inner pane is preferably of safety glass, and may be of toughened glass or may be a laminated pane comprising two sheets of glass which are laminated together with a plastics interlayer.

In one embodiment the outer pane is a toughened glass sheet, and the inner pane is a laminated pane comprising two sheets of glass which are laminated together with a plastics interlayer.

Usually for incorporation into a glass curtain wall assembly each unit is of rectangular form with a fixing assembly at a fixing position adjacent each corner and within the perimeter seal.

However, a unit in accordance with the invention may be secured in part by one or more fixing assemblies, and in part by other means, for example by an adhesive, or by bolts passing through one or more flanges formed by the outer pane extending beyond the periphery of the inner pane.

The invention also comprehends a glass assembly comprising an array of sealed multiple glazing units according to the invention, wherein the fixing members of each unit are fixed to supporting members with the outer edges of the units sealed edge-to-edge.

BRIEF DESCRIPTION OF THE DRAWINGS

Some embodiments of the invention will now be described, by way of example, with reference to the accompanying drawings, in which.

In each of the drawings the same reference numerals indicate the same or similar parts.

DETAILED DESCRIPTION

Figure 1:
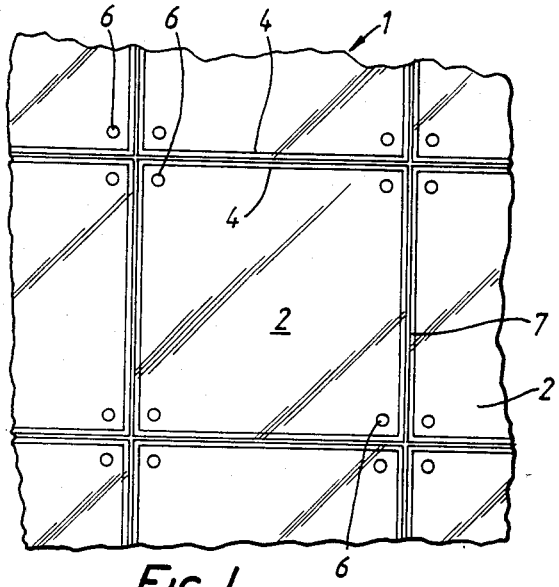
FIG. 1 is an elevation of part of the outside of a glass wall assembly constructed using sealed double glazing units according to the invention.

FIG. 1 illustrates part of a glass wall assembly according to the invention comprising a planar array of sealed multiple glazing units 1 which are mechanically secured to supporting members, not shown, behind the wall, which supporting members are a part of a structural framework to which the wall assembly is secured.

Figure 2:
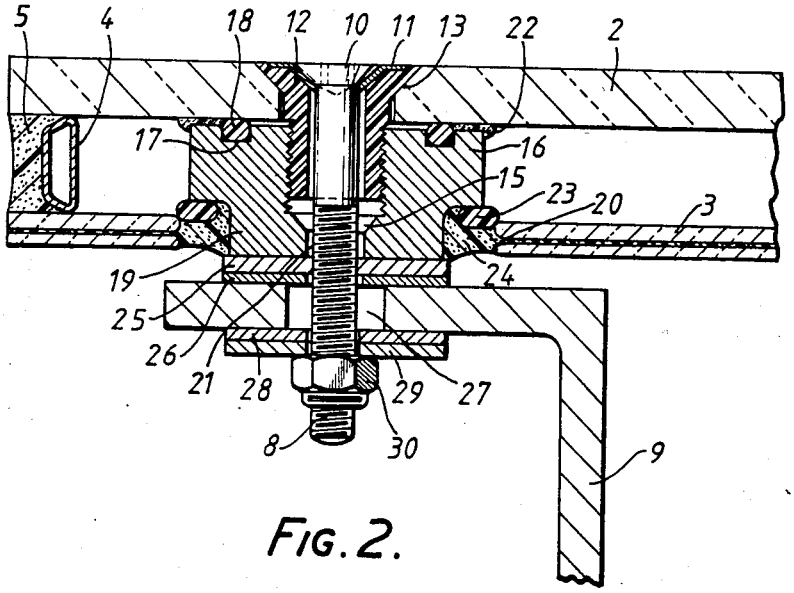
FIG. 2 is a part-sectional view showing in detail a fixing assembly for fixing to a supporting member one form of sealed double glazing unit according to the invention.

As shown in FIG. 2 each of the double glazing units comprises an outer pane 2 and an inner pane 3 which are spaced apart by a perimeter seal comprising a spacing frame 4 which is spaced inwardly from the edges of the panes 2 and 3 and a silicone sealant 5.

In the embodiment illustrated the outer pane 2 is a sheet of toughened glass 10mm thick, and the inner pane 3 is a laminated pane 6mm thick comprising two sheets of glass which are laminated together with a plastics interlayer in conventional manner. When toughened glass is used the glass sheets are drilled prior to toughening.

Each of the double glazing units 1 has four fixing positions, indicated at 6 in FIG. 1, within the perimeter seal, for fixing the unit in position without obstructing its outer edge. As shown in FIG. 1 the units are fixed edge-to-edge and the small gap 7 between adjacent edges of the units is sealed with a silicone sealant.

At each fixing position 6 there is a fixing assembly which is attached to the outer pane 2 only and is sealed in position within the unit so that flexing of the unit under wind load is permitted without impairing the seal of the double glazing unit. The fixing assembly passes through a hole in the inner pane 3 with a clearance sufficient to facilitate the flexing of the unit under wind load.

Each fixing assembly includes a fixing member in the form of a long bolt 8 which passes right through the unit and is secured to a supporting spring plate member 9 of the supporting structure for the wall assembly. In the embodiment of FIG. 2 the head 10 of the bolt 8 fits into a shaped stainless steel washer 11 which itself engages in a bush 12 made of resilient material, for example Nylon. The bush 12 has a tapered head which is a free fit in a countersunk hole 13 in the outer pane 2. The bush 12 carries the bolt 8 through the hole 13 in the outer pane and is a loose fit on the bolt. The outer surface of the bush 12 has a thread which engages with an internal thread in a central aperture 15 passing through a metal boss 16, for example of aluminium, which forms part of the fixing assembly and is positioned between and sealed to both panes 2 and 3.

The boss 16 is of generally cylindrical form with an annular groove 17 in its outer face, which groove 17 serves as a seating for a sealing O-ring 18 for example of Nylon or silicone rubber or Neoprene rubber. The inner portion 19 of the boss 16 is of reduced diameter and is situated in a hole 20 in the inner pane 3. The diameter of the hole 20 is just slightly greater than the larger outer diameter of the outer part of the boss 16 so that the boss can be inserted between the panes 2 and 3, through the hole 20, after the panes of the unit have been assembled together.

The central aperture 15 through the boss is tapered to a lower portion 21 which is of hexagonal internal shape and acts as a hexagonal socket for the insertion of a key which is used for tightening the boss 16 on to the thread of the bush 12. When assembling these parts a flexible silicone sealing compound 22 is spread between the outer surface of the boss 16 and the inner surface of the outer pane 2, over the sealing ring 18. When the boss 16 has been tightened in position on the bush 12, a sealing ring 23 is snapped into position around the reduced diameter portion 19 of the boss and between the shoulders of that portion and the edge of the hole 20, which hole 20 is then filled with the same flexible silicone sealing compound 24.

When the sealed double glazing unit has been thus assembled with a fixing assembly attached adjacent each corner, it is ready for installation. The head of the bolt 10 is flush with the outer surface of the outer pane 2 and the bottom of the boss 16 is flush with the outer surface of the inner pane 3. There is a clearance between the boss 16 and the inner pane, which clearance is sufficient to facilitate the flexing of the unit under wind load for example. When the unit is subject to wind load, the panes tend to bend at their centres either inwardly due to positive wind pressure or outwardly due to negative wind pressure. The boss 16 is firmly clamped to the outer pane 2 only so that it moves with the outer pane 2 and floats in the hole 20 in the inner pane 3, the seal between the inner pane 3 and the boss 16 being maintained by the flexibility of the sealing ring 23 and the sealing compound 24.

When installing each unit a circular stainless steel nut 25 is tightened on to the bolt 8 and this clamps the bush 12 and the boss 16 in position on the bolt. A resilient washer 26 is then threaded onto the bolt and the protruding end of the bolt is passed through a widehole 27 in a supporting spring plate member 9. A further resilient washer 28 is then placed over the bolt 8, followed by a stainless steel washer 29, and a self-locking nut 30 is tightened on to the end of the bolt to secure the corner fixing assembly of the double glazing unit to the member 9.

The resilient washers 26 and 28 may be stainless steel spring washers, or washers of silicone rubber or neoprene rubber.

The clearance between the hole 27 and the bolt 8 allows for thermal expansion of the glass wall assembly relative to the supporting members, such as the member 9. The spring plate members 9 are capable of elastic deflection under load.

The sealing compound used for the perimeter seal 5, for sealing the gaps 7 between adjacent units for providing the seals 22 and 24, is preferably a silicone sealant, which is stable when exposed to light.

Figure 3:
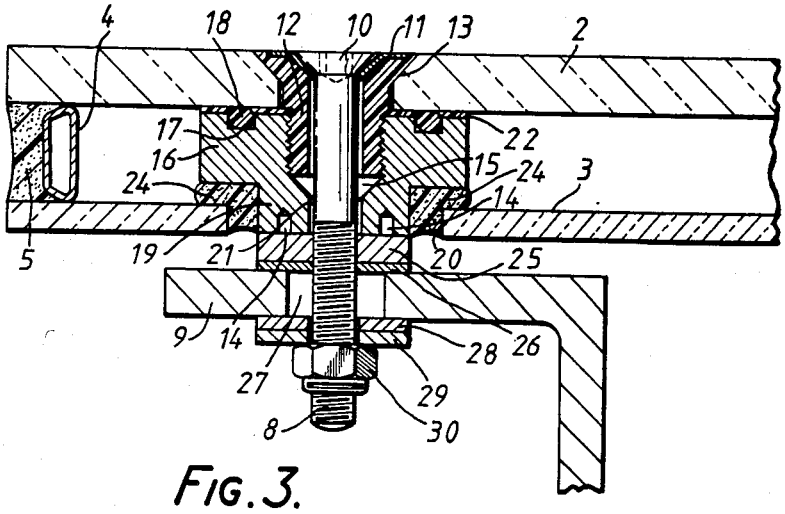
FIG. 3 is a view similar to FIG. 2 of a variant of the unit of FIG. 2.

FIG. 3 illustrates a variant of the fixing assembly of FIG. 2. The inner glass pane is a single sheet of glass which has been drilled before toughening. The outside diameter of the metal boss 16 is slightly larger than the diameter of the hole 20 and, during assembly of the unit, the boss 16 is located on the outer pane 2 before the inner pane 3 is placed on the spacing frame 4. The space between the boss 16 and the hole 20 is filled with sealing compound 24. A sealing ring, similar to the sealing ring 23 shown in FIG. 2, may be employed at this location. Movement of the fixing assembly by flexing of the seal 24 in the hole 20 is possible thereby facilitating the flexing of the sealed double glazing unit.

Figure 5:
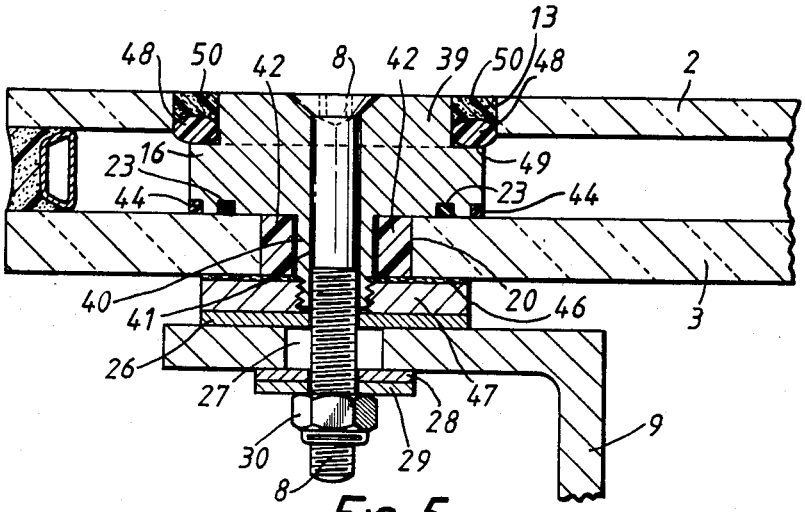
FIG. 5 illustrates a further embodiment of a sealed double glazing unit according to the invention.

In the embodiments of FIGS. 2 and 3 an annular Nylon cushion, similar to the cushion 44 shown in FIG. 5, may be located in a rabbet which is cut around the outer edge of the boss 16, to avoid contact, and possible resultant damage, between the outer edge of the boss 16 and the outer pane 2 when the unit flexes under wind load.

Figure 4:
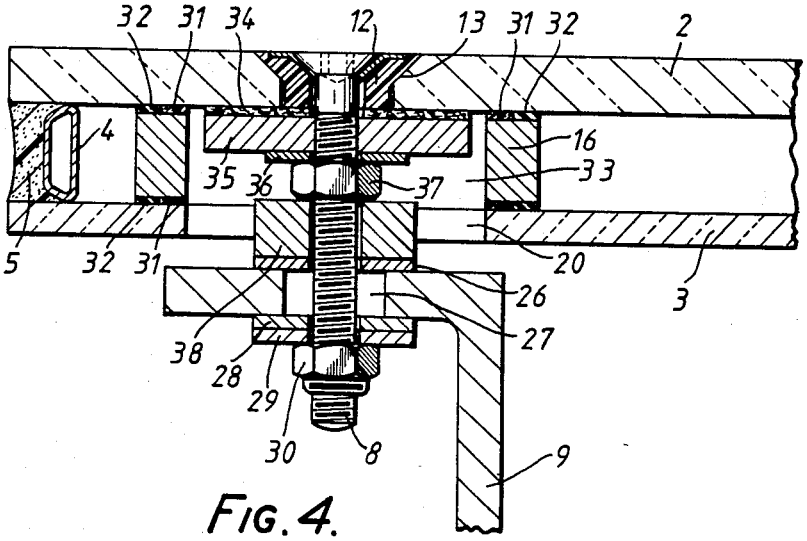
FIG. 4 illustrates another form of fixing unit in a sealed double glazing unit according to the invention.

FIG. 4 illustrates another form of sealed double glazing unit. During assembling of the panes 2 and 3 on the spacing frame 4, an annular spacer 16 is located between the panes and the end faces of the spacer are sealed to the panes by a composite seal consisting of an inner silicone seal 31 and an outer butyl seal 32. A hollow space 33 is thus provided within the spacer 16 for free location of the fixing assembly without detriment to the seal of the double glazing unit.

The double glazing unit may leave the factory in this form, and the further assembly steps can be completed on site.

The fixing bolt 8 passes through a bush 12 which is seated in a countersunk hole 13 in the outer pane 2 in the same way as in FIG. 2. The lower face of the bush 12 is co-planar with the inner face of the outer pane 2. A fibre washer 34 is placed on the bolt 8 and is clamped against the outer pane by a stainless steel clamping disc 35 which has an internal thread, which is tightened on to the bolt 8 by means of a tool which engages in holes, not shown, in the lower face of the disc 35.

A stainless steel washer 36 is located between a stainless steel clamping nut 37 and the disc 35, and the nut 37 is tightened on the bolt 8 to complete the fixing of the bolt 8 to the outer pane 2. The fixing assembly is thereby clamped to the outer pane 2 only.

When the fixing asembly is being attached to a spring plate member 9, a stainless steel distance piece 38 is first placed on the bolt and bears against the nut 37, and then the fixing bolt is secured to the member 9 in the same way as in FIG. 2. The large clearance for movement of the distance piece 38 in the hole permits the flexing of the unit when it is in position.

In the embodiment of FIG. 5 a solid aluminium boss 16 is used, which is similar to the boss of FIGS. 2 and 3. In this embodiment the boss 16 is clamped to the inner pane 3 only, and floats in a larger hole 13 in the outer pane 2. The central part of the boss 16 is of larger diameter, and a reduced diameter outer part 39 floats within the hole 13. The boss 16 has a central, externally threaded extension 40 which extends through the hole 20 in the inner pane. The boss 16 has a central bore which is hexagonal at 41 within the extension 40, and is countersunk at the other face of the boss for seating the head of the bolt 8.

Before the double glazing unit is made up the boss 16 is attached to the inner pane 2. A loosely fitting Nylon bush 42 is threaded on to the boss extension 40. This bush 42 is dimensioned to fit loosely around the extension 40 in the hole 20 in the inner pane 3. A Neoprene rubber O-ring 23 is fitted into an annular groove provided in the boss face, and an annular Nylon cushion 44 is fitted in a rabbet cut around the outer edge of the boss. This helps to avoid damage to the glass when the unit flexes under wind load.

The assembled boss 16 with its bush 42 is positioned through the hole 20 in the inner pane 3 and a fibre gasket 46 is placed against the face of the pane 3 followed by a threaded stainless steel clamping disc 47 which is tightened on to the boss extension 40 using a C-spanner, while the extension 40 is held by a hexagonal tool which fits in to the hexagonal bore 42. The boss is thus fixed to the inner pane 3 and is sealed to that pane by the O-ring 23.

The double glazing unit is then assembled with the boss assembly in position. A butyl seal 48 is placed on the shoulder 49 formed where the reduced diameter part 39 of the boss begins, and when the outer pane 2 is in position silicone sealing compound 50 completes the seal of the floating part 39 of the boss within the hole 13 in the outer pane. The double glazing unit, when sealed, is then ready for shipping, and on site the bolt 8 is inserted and the assembly fixed to a spring plate member 9 as previously described.

Figure 6:
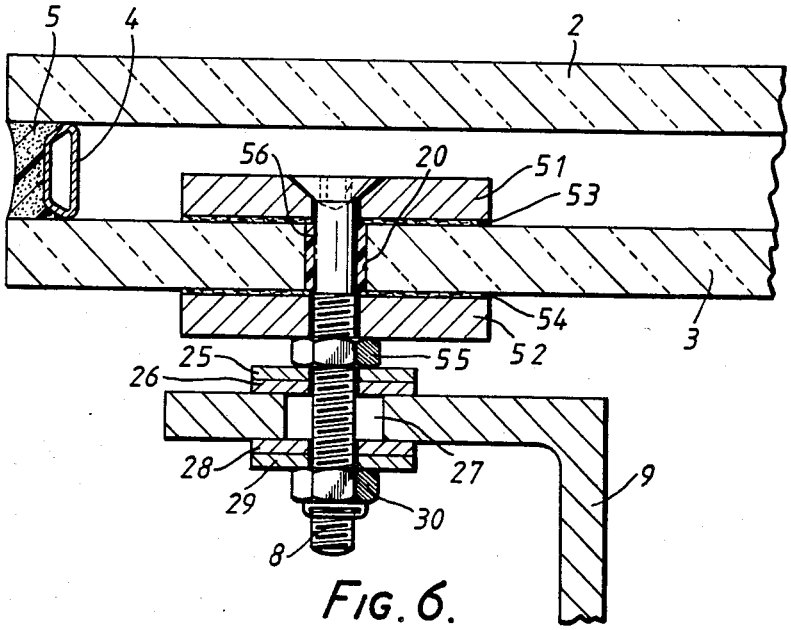
FIG. 6 illustrates yet another embodiment of the invention.

A simple form of the invention is shown in FIG. 6, in which embodiment each fixing assembly is attached to the inner pane only. No boss is employed, and the bolt 8 passes simply through a complementary hole 20 in the inner pane. Butyl sealant is inserted in the hole 20 before the bolt is inserted.

Before the double glazing unit is assembled, two aluminium discs 51 and 52, with intervening fibre gaskets 53 and 54, are clamped on to the inner pane 3 by means of a stainless steel clamping nut 55. The butyl sealant 56 in the hole 20 seals the fixing assembly to the inner pane 3.

The double glazing unit is then assembled with the bolts 8 projecting from the inner pane 3 for eventual fixing to spring plate members 9 in the same way as in FIGS. 2 and 3. The play of the resilient washers 26 and 28 and the relative flexing of the pane 2 and 3 can facilitate appropriately the flexing of the sealed double glazing unit.

Larger double glazing units for example of size 2m x 2m or greater may require additional fixing positions along their sides, for example an additional central fixing position at each side within the perimeter seal. When working with triangular units the fixing positions will, usually be adjacent the corners within the perimeter seal. Larger triangular units may also require additional fixing positions at one or more sides.

We claim:

1. A sealed double glazing unit comprising: an outer pane and an inner pane which are spaced apart by perimeter sealing means, and at least one fixing means for fixing the unit to a supporting member, which fixing means is attached to one of said panes inwardly of said perimeter sealing means without obstructing the outer edge of the unit, said fixing means being operable to permit the unit to flex under wind load without impairing the sealing of the unit by said perimeter sealing means.

2. A sealed double glazing unit comprising: an outer pane and an inner pane which are spaced apart by perimeter sealing means, and at least one fixing means for fixing the unit to a supporting member, which fixing means passes through a hole in one of said panes and is clamped to said one pane only inwardly of said perimeter sealing means without obstructing the outer edge of the unit, said fixing means being operable to permit the unit to flex under wind load without impairing the sealing of the unit by said perimeter sealing means.

3. A unit as claimed in claim 2, wherein: said fixing means passes through a sealed hole in the other of said panes with a clearance sufficient to facilitate the flexing of the unit under wind load.

4. A sealed double glazing unit comprising: an outer pane and an inner pane which are spaced apart by perimeter sealing means, and at least one fixing means for fixing the unit to a supporting member, which fixing means passes through a hole in said outer pane and through a hole in said inner pane at a positioin spaced inwardly of said peripheral sealing means without obstructing the outer edge of the unit, said fixing means being clamped to said outer pane and passing through said hole in said inner pane with a clearance sufficient to permit the unit to flex without impairing the sealing of the unit by said perimeter sealing means, sand said fixing means including a boss positioned between and sealed to both said panes.

5. A sealed double glazing unit comprising: an outer pane and an inner pane which are spaced apart by perimeter sealing means, and at least one fixing means for fixing the unit to a supporting member, which fixing means passes through a hole in one of said panes and is clamped to said one pane only inwardly of said perimeter sealing means without obstructing the outer edge of the unit, said fixing means including a fixing member which passes through said hole in said one of the panes, and a boss through which said fixing member passes, said boss being positioned between and sealed to both said panes and passing through a sealed hole in the other of said panes with a clearance sufficient to permit the unit to flex under wind load without impairing the sealing of the unit by said perimeter sealing means.

6. A unit as claimed in claim 5, wherein: said fixing means is attached to said outer pane, said fixing member is a fixing bolt whose head engages in a bush which is a part of said fixing means and which is free fit in said hole in said outer pane, which hole is countersunk to accommodate said bush.

7. A unit as claimed in claim 6, wherein: said boss has an internal thread and is tightened on to an external thread on said bush to clamp said fixing means to said outer pane, and said fixing bolt projects from said boss for fixing to a supporting member.

8. A unit as claimed in claim 7, wherein: said boss is a metal boss and carries a sealing ring between said boss and said outer pane, and said boss has a reduced-diameter portion which is situated with clearance in a said sealed hole in said inner pane, which hole is sealed with a sealing compound.

9. A unit as claimed in claim 8, including a sealing ring between said boss and the edge of said sealed hole in said inner pane.

10. A sealed double glazing unit comprising: an outer pane and an inner pane which are spaced apart by perimeter sealing means, at least one fixing means located inwardly of said perimeter sealing means for fixing the unit to a supporting member without obstructing its outer edge, said fixing means including a fixing bolt whose head engages in a bush which is part of said fixing means and which is a free fit in a hole in said outer pane, said bush being clamped in said outer pane by a disc which is tightened on said fixing bolt, said fixing bolt passing through a hole in said inner pane with clearance sufficient to facilitate the flexing of the unit under wind load without impairing the sealing of the unit by said perimeter sealing means, and said glazing unit further including an annular spacer which is sealed to both said panes and surrounds said fixing bolt and said hole in said inner pane.

11. A sealed double glazing unit comprising: an outer pane and an inner pane which are spaced apart by perimeter sealing means, at least one fixing means located inwardly of said perimeter sealing means for fixing the unit to a supporting member without obstructing its outer edge, said fixing means being clamped to said inner pane only, said fixing means including a boss through which a fixing bolt of said fixing means passes, said boss being positioned between and sealed to both said panes and being located with clearance in a hole in said outer pane and being sealed within that hole, said boss having a central, externally-threaded extension which passes through a hole in said inner pane, said fixing means further including a threaded disc screwed on to said extension of said boss to clamp said boss to said inner pane, said fixing bolt passing through said boss and its extension for fixing to a supporting member, and the clearance between said boss and said hole in said outer pane being sufficient to facilitate flexing of the unit under wind load without impairing the sealing of the unit by said perimeter sealing means.

12. A unit as claimed in claim 6 or claim 10, wherein: said bush is made of a resilient material and has a tapered head which fits into said hole in said outer pane.

13. A unit as claimed in claim 2, wherein: said fixing means includes a fixing member which passes through a hole in said inner pane and which is clamped to said inner pane and sealed in said hole in said inner pane prior to assembly of the unit.

14. A unit as claimed in claim 1 or claim 4, wherein: said outer pane is a toughened glass sheet, and said inner pane is a laminated pane comprising two sheets of glass which are laminated together with a plastics interlayer.

15. A sealed double glazing unit of rectangular form comprising: an outer pane and an inner pane which are spaced apart by perimeter sealing means, and fixing means adjacent each corner of the unit, and at a position spaced inwardly of said perimeter sealing means, for fixing the unit to a supporting member without obstructing the outer edge of the unit, which fixing means is attached to one of said panes, said fixing means being operable to permit the unit to flex under wind load without impairing the sealing of the unit by said perimeter sealing means.

16. A unit as claimed in claim 15, wherein: said fixing means passes through a hole in said one of said panes and is clamped to that pane only.

17. A unit as claimed in claim 16, wherein: said fixing means passes through a sealed hole in the other of said panes with a clearance sufficient to facilitate the flexing of the unit under wind load.

18. A glass assembly comprising: an array of sealed multiple glazing units each comprising an outer pane and an inner pane which are spaced apart by perimeter sealing means, and at each of a plurality of locations spaced inwardly of said perimeter sealing means, fixing means for fixing the unit to a support without obstructing the outer edge of the unit, each said fixing means being attached to one of said panes, said fixing means being operable to permit the unit to flex under wind load without impairing the sealing of the unit by said perimeter sealing means, and said fixing means being fixed to supporting members with the outer edges of the units sealed edge-to-edge to constitute a glass wall assembly.

* * * * *